US008714348B2

(12) United States Patent
Vargas

(10) Patent No.: US 8,714,348 B2
(45) Date of Patent: May 6, 2014

(54) POSTER CUP

(75) Inventor: Rodrigo Vargas, Miami, FL (US)

(73) Assignee: Goldar Investments LLC, Miami, FL (US)

( * ) Notice: Subject to any disclaimer, the term of this patent is extended or adjusted under 35 U.S.C. 154(b) by 0 days.

(21) Appl. No.: 13/366,312

(22) Filed: Feb. 4, 2012

(65) Prior Publication Data

US 2013/0319894 A1 Dec. 5, 2013

(51) Int. Cl.
*B65D 85/00* (2006.01)

(52) U.S. Cl.
USPC ..... 206/217; 206/459.5; 206/505; 40/324

(58) Field of Classification Search
USPC ..... 206/459.1, 459.5, 457, 503, 505, 509, 206/499, 217, 224; 40/324
See application file for complete search history.

(56) References Cited

U.S. PATENT DOCUMENTS

| | | | | | |
|---|---|---|---|---|---|
| 1,770,118 | A * | 7/1930 | Williams | 206/217 |
| 3,100,487 | A * | 8/1963 | Bathish | 604/257 |
| 3,308,962 | A * | 3/1967 | Bryant | 211/74 |
| 3,574,957 | A * | 4/1971 | Bello-Bridick | 434/173 |
| 3,820,684 | A * | 6/1974 | Harrison | 6/520 |
| 4,092,055 | A * | 5/1978 | Wullenwaber | 312/45 |
| 4,713,900 | A * | 12/1987 | Calloway et al. | 40/324 |
| 4,883,188 | A * | 11/1989 | Barth | 215/12.1 |
| 4,991,716 | A * | 2/1991 | Havlovitz | 206/335 |
| 5,525,383 | A * | 6/1996 | Witkowski | 428/30 |
| 5,820,016 | A * | 10/1998 | Stropkay | 229/403 |
| 6,053,352 | A * | 4/2000 | Cai | 220/739 |
| 6,250,545 | B1 * | 6/2001 | Mazzarolo et al. | 229/403 |
| 6,718,664 | B2 * | 4/2004 | Williams | 40/324 |
| 6,769,545 | B1 * | 8/2004 | Mallams | 206/534 |
| 7,581,643 | B2 * | 9/2009 | Wilskey et al. | 206/736 |
| 7,806,296 | B2 * | 10/2010 | Connors | 222/78 |
| 2003/0121189 | A1 * | 7/2003 | Williams | 40/324 |
| 2009/0300955 | A1 * | 12/2009 | Puglisi | 40/334 |
| 2010/0294690 | A1 * | 11/2010 | Butler et al. | 206/459.5 |

* cited by examiner

*Primary Examiner* — Jacob K Ackun
(74) *Attorney, Agent, or Firm* — Richard C. Litman

(57) ABSTRACT

The present invention relates generally to a consumable beverage container, and more particularly to collectible cups including graphical souvenir, art, or thematic elements presented on the exterior surface of the container that remains exposed upon the nesting or stacking of each unit. While such elements may present a cohesive brand or image presence on each cup, the elements also represent a fragment of a larger design that may only be visible upon proper vertical sequencing and rotational orientation of the various individual units within the particular series or collection of containers. The exact geometry of the containers may be counter intuitively formulated to present a larger exposed surface for the presentation of such elements thereby sacrificing the volumetric savings normally associated with the nesting or stacking of equivalently-sized units in a storage or retail setting.

4 Claims, 6 Drawing Sheets

POSTER CUP

RELATED U.S. APPLICATION DATA

None.

FIELD OF THE INVENTION

This invention relates in particular to a plurality of stackable beverage containers for which an end-user is likely to aggregate multiple discrete units as part of a collection or grouping while desiring to visually convey a concept or theme when the units are stacked or nested one inside another.

BACKGROUND OF THE INVENTION

There are many reasons an end-user may seek to have access to a large number of identically sized beverage containers. Whether as a restaurant proprietor or setting a table for holiday dinner consumers require multiple units of similar sized vessels. Given this well-established need, ingenious marketers have defined innumerable ways of applying indicia, labels, or graphics upon containers of all shapes and sizes to designate factors irrelevant to the consumption of the contents of these containers. Such factors include, but are not limited to: manufacturer or source of origin of the vessel or its contents, affinity for a particular location, emotion, or concept, and advertising of consumer brands, sports teams, movies, or the like. Disposable and re-usable beverage containers in a variety of materials have also been promoted as collectibles in which each unit of the collection may differ from the others in terms of a particular character, color, image, or other attribute within the overall concept of the collection. The novel characteristic of the present invention, however, is that the collection of containers not only comprises a conceptually similar group of individual units, but also physically presents a composite image when the individual units are nested together into a single whole article.

BRIEF SUMMARY OF THE INVENTION

The invention comprises a concept of conveying an image by geometrically aggregating a number of identically sized beverage containers. The actual size, geometry, and relative dimensions of the individual container units are without constraint subject to the limitation that the containers must have identical geometry within each set to facilitate stacking, nesting, or interlocking of multiple discrete units such that a portion of the surface of each unit remains exposed to an observer for the presentation of an image component or fragment, the aggregation of which fragments comprises a larger image. The preservation of this exposed surface area is of the utmost importance to the assembly of the composite message when the discrete units are nested together. This exposed surface area is so critical that the specific relative dimensions of the beverage container may be counter intuitively formulated to present a larger exposed surface for the presentation of such elements thereby sacrificing the volumetric efficiency which is normally the reason for the nesting or stacking of equivalently-sized units in a storage or retail setting. In a standard tapering tumbler, a beverage container may present a larger diameter across the top opening edge than at the smaller closed edge to facilitate nearly complete overlap of the stacked units such that the overall height of two stacked units is but a small fraction greater (e.g. 2-3%) than the overall height of a single unit alone. In this nominal condition, the excess height percentage may decrease in magnitude down to a single thickness of the material used to manufacture the tumblers. For the instant invention, the overall height of two stacked units could be much greater (e.g. 110%-190%) than the overall height of a single unit alone in order to present the greatest possible exposed surface area to convey the composite image. An ancillary side effect of these relative dimensions is that a series of beverage containers normally nested together would necessitate a greater volume for storage and shipping which could potentially increase the unit cost to bring such items to market.

DETAILED DESCRIPTION OF THE INVENTION

Figure 1:
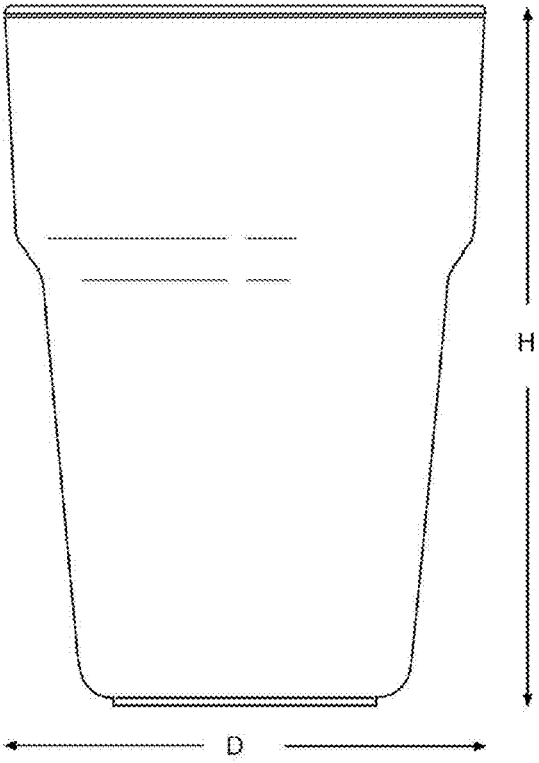
FIG. 1 is a side view of a beverage container of overall height "H" and overall diameter "D" illustrating the sharp decrease in diameter from top to bottom inherent for that portion of the surface area obstructed from view when identically sized units are vertically stacked.

Through ingenious combinations of Beverage Container geometry and Subcomponent Images, a Composite Image is revealed through the aggregation of a collection of identically sized discrete container units when stacked or nested together in the proper orientation into a larger composite whole unit. The state of the art for Beverage Containers is mature and many prior applications have been awarded for particular shapes, sizes, and materials of Beverage Containers. The instant invention advocates usage of these pre-existing physical features to support the function of conveying, presenting, or implying a Composite Image through the aggregation of discrete units of a series or collection not merely as a unique members of a group in close proximity, but rather as a cohesively whole physical unit comprised of the various discrete units. While the Subcomponent Image inherent on each discrete container may present some modicum of message or value in and of itself, the entirety of the concept or image is not fully discernible unless and until the correct discrete units are aggregated in the proper geometric orientation through stacking or nesting together.

In the most basic embodiment of the present invention, a plurality of Beverage Containers are described with a Subcomponent Image positioned in a horizontal stripe on the purpose-driven extra tall rim of a series of standard stacking tumblers. Such a series of Beverage Containers is envisioned to be distributed in a commemorative fashion at sporting events, entertainment venues, or restaurants. Consumers may have the option of purchasing an entire collection containing a single unit of each type within the series or simply collect a random single unit upon completing each beverage purchase in the hopes of receiving the necessary units of each type to assemble the entire Composite Image. Said Composite Image would not become evident prior to the proper vertical sequencing and rotational orientation of the discrete units within the series of the collection. For a circular cross-section container an almost infinite number of rotational orientations would be possible although only a single unique positioning of the discrete units would reveal the Composite Image.

It is another object of the present invention to describe a plurality of Beverage Containers comprising a cross-section corresponding to a regular polygon having a multiplicity of equilateral sides. Such a series of containers would reduce the potential variance of rotational orientations to a finite number corresponding to the number of sides of the cross section. For example, two discrete units comprising an octagonal cross-section could only stack or nest together in eight discrete rotational steps corresponding to forty-five degrees of angular displacement. Such a limited number of rotational options would facilitate the assembly and aggregation of the Composite Image.

It is yet another object of the present invention to describe a plurality of Beverage Containers comprising a cross-section of an irregular polygon or rotationally asymmetrical shape. Such a series of containers would reduce the potential variance of rotational orientations to a single unique positioning. For example, two discrete units comprising the cross-section of a scalene triangle or an otherwise regular shape with an inward or outward alignment groove or notch could only stack or nest together in a single position. The Subcomponent Image could then be positioned accordingly on each discrete unit such that when the individual units are properly orientated, the Composite Image is revealed. The irregularity or asymmetry could also be induced into the cross section through a feature serving a secondary purpose in the consumption or transport of the target beverage such as a handle, pour spout, or the like. Such feature could provide not only rotational alignment, but vertical or relative geometric positioning as well to ensure that the Subcomponent Images are visible in the most effective way to convey the Composite Images.

It is yet another further object of the present invention to describe that the Subcomponent Images and the aggregate Composite Image need not be limited to two-dimensional artwork. For example, the Subcomponent Image on a Beverage Container could be comprised of a pattern of ridges, textures, or bumps that, when combined and properly oriented with another Beverage Container in the series of Beverage Containers evinces Composite Image comprising a visually or tactilely discernible pattern.

DETAILED DESCRIPTION OF THE PREFERRED EMBODIMENT

Figure 2:
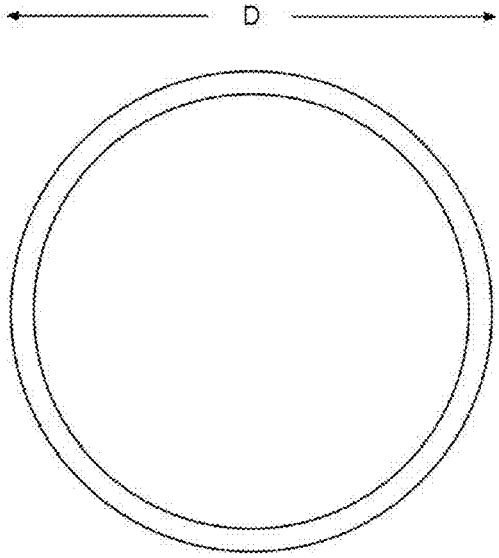
FIG. 2 is a top view of a standard circular cross-section beverage container as depicted in the drawings.

The preferred embodiment of the invention uses as its foundation a plurality of standard stackable tumblers manufactured from thermoformed plastic, glass, or other similar material. The Beverage Container geometry is significantly wide rather than tall and narrow in order to provide a greater breadth of visual surface area. As shown in the elevation view of FIG. 1, each Container comprises a reducing cross sectional area for the dual purposes of generating a positive draft in the manufacturing process as well as providing for the nesting or stacking of the exterior bottom surface of one discrete Beverage Container and the top Opening of a second identically-proportioned Beverage Container. FIG. 1 also depicts a knuckle or chine that marks the edge of the wide upper rim of the Beverage Container and ensures that the exterior surface area of the rim shall remain visible to an observer while one discrete Beverage Container is nested or stacked one inside another. The exposed rim of each Beverage Container is designed to be a significant fraction of the overall height "H" in order to present a greater surface area for the inclusion and appreciation of a Subcomponent Image. The acceptable result of the increased height of each Beverage Container rim is that, when the discrete units are stacked or nested together, there will be volumetric waste equivalent to an area with the same height as the rim in the bottom of each discrete stacked unit. This embodiment of the invention comprises Beverage Containers of a circular cross section of overall outside Diameter "D" as shown in the top view of FIG. 2.

Figure 3:
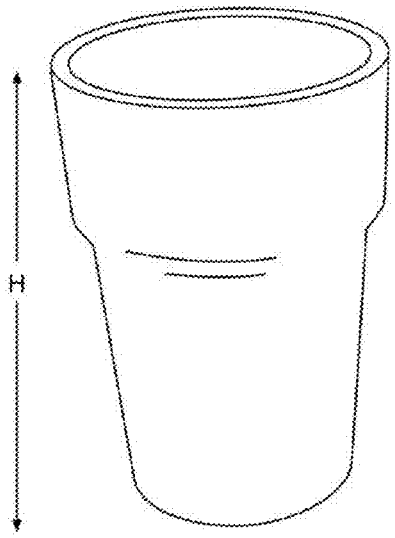
FIG. 3 is a three-dimensional perspective view of a circular cross-sectional beverage container showing an overall height "H" and the decrease sharp reduction in outside diameter.
Figure 4:
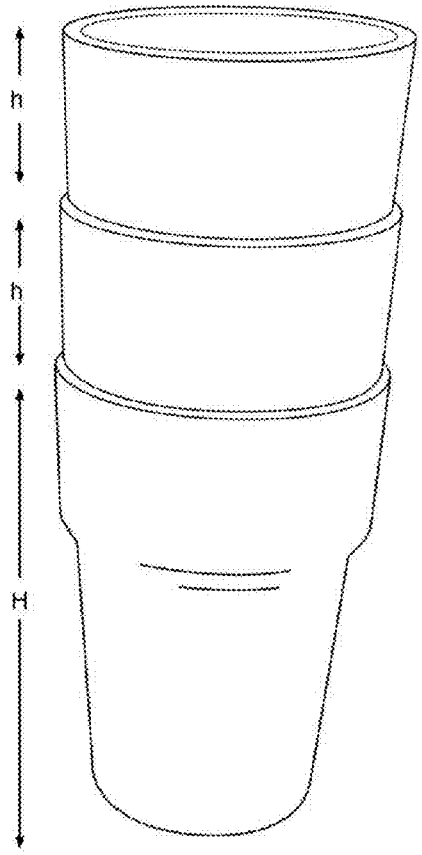
FIG. 4 is a three-dimensional perspective view of a series of three containers vertically stacked illustrating the overall height "H" of the bottom container and the exposed height "h" of each subsequent container that remains visible upon nesting of the individual units.

FIG. 3 is a three-dimensional perspective view of one of the discrete Beverage Containers in the plurality of Beverage Containers in the preferred embodiment showing a circular cross-sectional Beverage Container comprising an overall height "H" and the sharp reduction in outside diameter at the base of the rim described above. FIG. 4 is a three-dimensional perspective view of a series of three containers vertically stacked illustrating the overall height "H" of the bottom container and the exposed rim height "h" of each subsequent container that remains visible upon nesting or stacking of the individual units.

Figure 5:
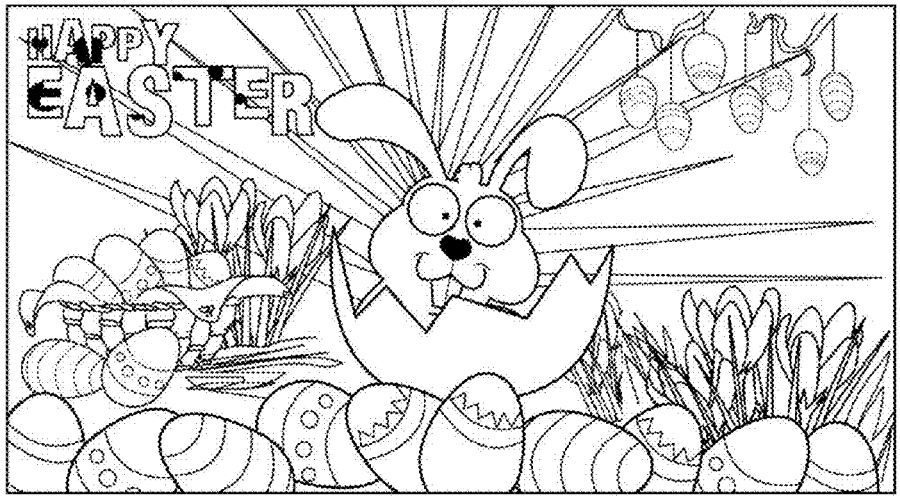
FIG. 5 is a sample thematic composite design image.
Figure 6:
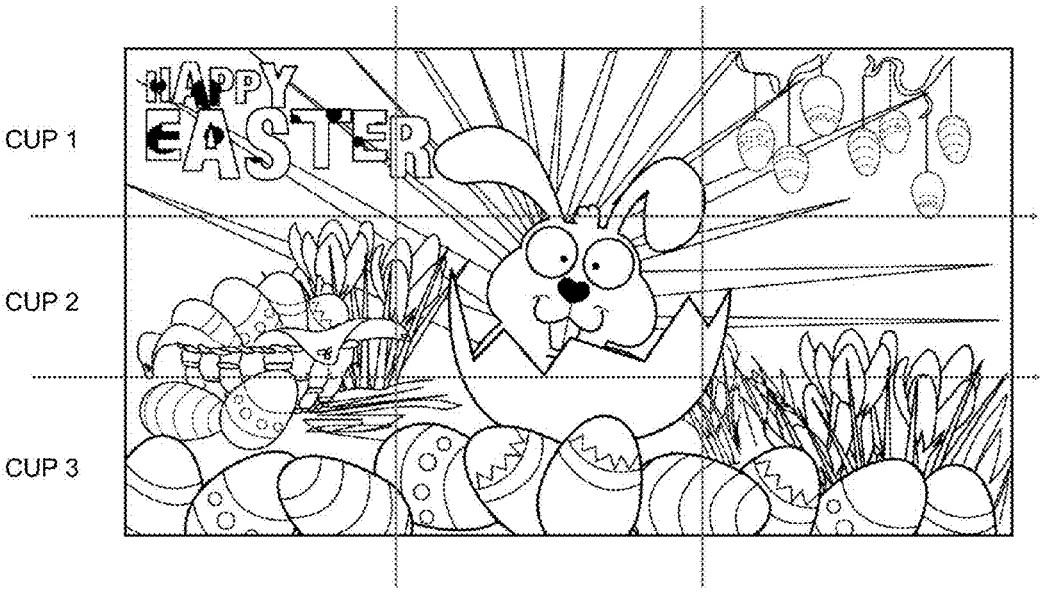
FIG. 6 shows the sample thematic composite design image partitioned into horizontal fragments which become circumferential stripes for inclusion on each container unit as well as vertical fragments representing one-third circumferential views with a primary graphical focal point for each view.

In the described sample of the preferred embodiment, the Composite Image is a celebration of the holiday of Easter as illustrated in FIG. 5. This sample Composite Image is partitioned as shown in FIG. 6 for a simple collection of containers comprising 3 unique discrete units. Each of the discrete Beverage Containers will include a Subcomponent Image of height "h" corresponding to a horizontal fragment of the sample Composite Image which become circumferential stripes for inclusion on the rim of each discrete Beverage Container unit. Considerable design talent is necessary in the formulation of the Composite Image as each Subcomponent Image must have meaning for the end-user as well. In the described sample, Cup 1's primary image face is the words "Happy Easter," Cup 2's primary image face is the cartoonish Easter Rabbit, and Cup 3's primary image face is an endless series of colorful celebratory Easter eggs.

Figure 7:
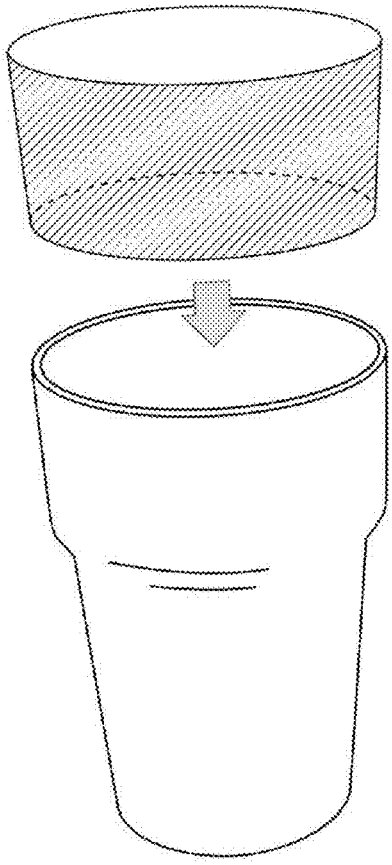
FIG. 7 depicts a horizontal image fragment being applied to the exposed height "h" of a container unit.
Figure 8:
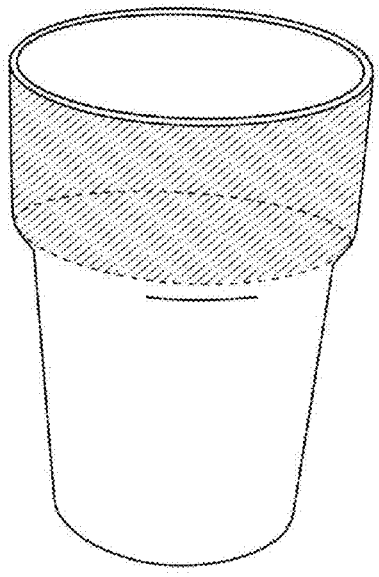
FIG. 8 represents the horizontal image fragment attached to the exposed height "h" of a container unit.
Figure 9:
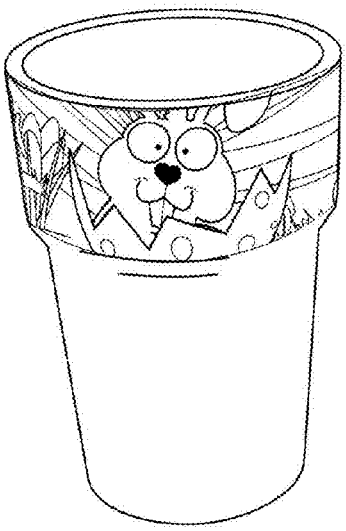
FIG. 9 further clarifies FIG. 8 by detailing a sample horizontal image fragment from FIG. 6 attached to the exposed height "h" of a container unit.

Each horizontal fragment of the Composite Image becomes a circumferential stripe for application on or integration at manufacture with the rim of the plurality of Beverage Containers. Said Subcomponent Images may be applied via adhesive or electrochemical means post-manufacture, or dyed, injected, or applied as part of the in-mold manufacturing process. FIG. 7 shows the application of the Subcomponent Image to the rim of the Beverage Container while FIG. 8 shows the Subcomponent Image's correlation with the geometric height "h" of the Beverage Container rim. FIG. 9 further clarifies FIG. 8 by detailing a sample Subcomponent Image from FIG. 6 attached to the exposed rim height "h" of a discrete Beverage Container unit.

Figure 10:
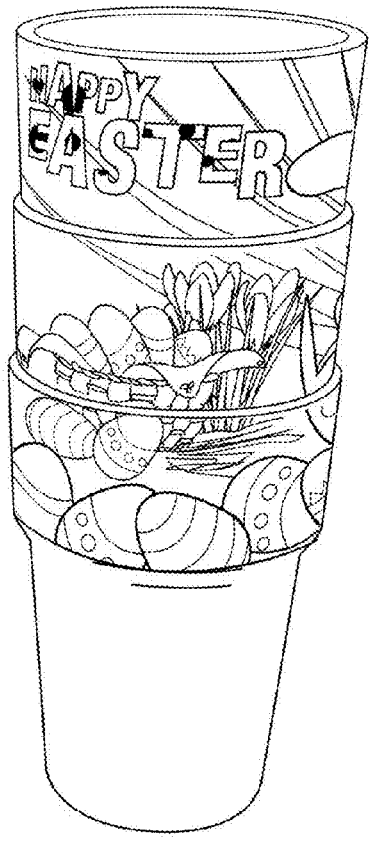
FIG. 10 further clarifies FIG. 4 by detailing the series of horizontal image fragments from FIG. 6 presented in the proper vertical sequence and rotational orientation to present a contiguous vertical image view.
Figure 11:
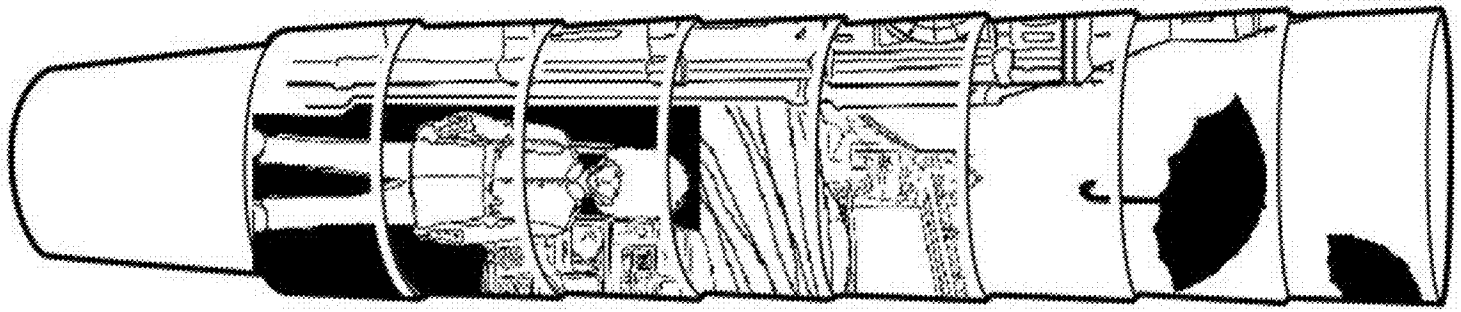
FIG. 11 represents another embodiment of the invention comprising different graphical thematic elements and necessitating a greater number of discrete units to complete assembly of the larger image design.
Figure 12:
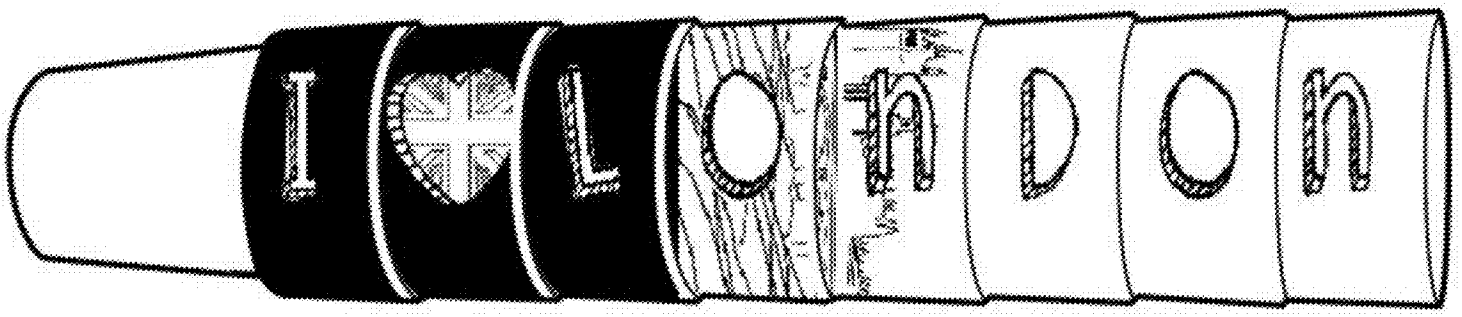
FIG. 12 represents a rotational view of FIG. 11, comprising different graphical thematic elements.

The sample Composite Image is shown in FIG. 10 applied to three discrete Beverage Container units with each unit stacked or nested in the proper vertical sequence. Each discrete unit is also presented in the proper rotational orientation to present the cohesive Composite Image on the exposed external surfaces of the Beverage Container rims. Another example of the preferred embodiment comprising an alternate Composite Image is presented in FIG. 11. This Composite Image celebrates the city of London and includes a number of widely recognized symbols of that world-class city as well as explicitly spelling out "I [heart] LONDON" in another rotational view of the same sample Composite Image in FIG. 12. A plurality of eight discrete Beverage Container units would be required with eight different Subcomponent Images in order to convey the totality of the Composite Image in this example.

What is claimed is:

1. A kit for exhibiting a unique graphic theme, comprising:

a plurality of individual beverage containers, each of the containers being sized and dimensioned to be nested together, each container including an open top, a closed bottom and a body portion, the body portion enclosing an internal volume;

the body portion having a lower portion and an upper portion, wherein the lower portion defines the nesting region and the upper portion defines a rim that protrudes outwardly from the lower portion and defines the open top, the rim having a continuous periphery;

a discrete graphic image disposed only on each rim, the discrete graphic image extending continuously around the entire periphery of the rim, wherein the height of the rim is sufficient to remain visible upon nesting of the individual beverage containers, whereby a unique graphic image is displayed by nesting the plurality of individual beverage containers so that the discrete images are properly aligned and arranged in proper sequence thereby displaying the totality of the unique graphic image about the entire periphery of the rim.

2. The kit for exhibiting a unique graphic theme according to claim 1, wherein the beverage containers are identical in size and configuration.

3. The kit for exhibiting a unique graphic theme according to claim 1, wherein the lower body portion tapers outwardly from at least the closed bottom to the start of the protruding rim.

4. The kit for exhibiting a unique graphic theme according to claim 1, including alignment indicia disposed on each discrete graphic image for determining if the discrete images are properly oriented and aligned.

* * * * *